US006692099B2

(12) United States Patent
Rio Doval

(10) Patent No.: US 6,692,099 B2
(45) Date of Patent: Feb. 17, 2004

(54) TESTING NOZZLES IN PRINT HEADS

(75) Inventor: Jose M Rio Doval, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/843,883

(22) Filed: Apr. 30, 2001

(65) Prior Publication Data

US 2002/0158938 A1 Oct. 31, 2002

(51) Int. Cl.[7] ..... B41J 2/165
(52) U.S. Cl. ..... 347/22; 347/81
(58) Field of Search ..... 347/22, 19, 29, 347/30, 33, 35, 36, 42, 81; 400/74

(56) References Cited

U.S. PATENT DOCUMENTS 6,086,190 A * 7/2000 Schantz et al. ..... 347/81
6,193,353 B1 * 2/2001 Vives et al. ..... 347/29
6,238,112 B1 * 5/2001 Girones et al. ..... 347/42

* cited by examiner

*Primary Examiner*—Shih-wen Hsieh

(57) ABSTRACT

A printer device having a plurality of print heads for printing onto a print medium. Each of the print heads having a plurality of nozzles formed into at least two rows. A service station housed within the printer device having a plurality of service station units for performing servicing operations on the print heads. A plurality of ink drop detector modules being integrated into respective ones of the service station units for detecting malfunctioning nozzles on the plurality of print heads. The ink drop detector modules may be configured to test the nozzles of each row of nozzles on at least one of the print heads simultaneously. And, according to a preferred embodiment, each row of nozzles of each print head are tested simultaneously to thereby substantially reduce the amount of time required to test the functionality of the nozzles.

26 Claims, 7 Drawing Sheets

TESTING NOZZLES IN PRINT HEADS

FIELD OF THE INVENTION

This invention relates generally to printer devices. More particularly, the invention pertains to a multichannel system and a method for simultaneously detecting malfunctioning nozzles in a plurality of print heads of a large format printer device to thereby reduce the amount of time required to test whether the nozzles are operating properly.

BACKGROUND OF THE INVENTION

It is known to produce copies of files on a print media from a host device, e.g., a computer, a facsimile machine, a photocopier, etc., using a printer device. Among the known methods for printing text and the like onto a print medium, it is known to build an image on the print medium by spraying droplets of ink from nozzles provided on print heads of a printer.

As seen in FIG. 1, there is schematically illustrated a part of a known printer device (e.g., a large format printing device) having an array of print heads 100 in a parallel row. More specifically, FIG. 1 illustrates six print heads 102–112. Each of the print heads 102–112 includes a plurality of printer nozzles 202–200*n*, arranged in two rows, (see FIG. 2) for firing ink onto a print medium 120. Although FIG. 1 depicts the printer device as having six print heads 102–112, printer devices have been known to possess any number of print heads, e.g., two, four, or more. Additionally, although FIG. 2 depicts the print heads 102–112 as possessing two rows of nozzles 202–202*n*, print heads have been known to possess any number of nozzle rows, e.g., one, two, or more.

Referring back to FIG. 1, in a conventional printer device, the print heads 102–112 are constrained to move in a direction 170 with respect to the print medium 120, e.g., a sheet of paper. In addition, the print medium 120 is also constrained to move in a further direction 160. During a normal print operation, the print heads 102–112 are moved into a first position with respect to the print medium 120 and a plurality of ink droplets are fired from the same plurality of printer nozzles contained within each of the print heads 102–112. After completion of a print operation, the print heads 102–112 are moved in a direction 170 to a second position and another print operation is performed. In a like manner, the print heads 102–112 are repeatedly moved in a direction 170 across the print medium 120 and a print operation is performed after each such movement of the print heads 102–112. When the print heads 102–112 reach an edge of the print medium 120, the print medium is moved a short distance in a direction 160, parallel to a main length of the print medium 120, and another print operation is performed. The print heads 1021 112 are then moved in a direction 170 back across the print medium 120 and yet another print operation is performed. In this manner, a complete printed page may be produced.

A more detailed description of the printer device illustrated in FIG. 1 may be found in commonly assigned application Ser. No. 09/502,667, filed on Feb. 11, 2000, by Xavier Bruch et al., (corresponding to Application No. 20020140760, published on Oct. 3, 2002, now U.S. Pat. No. 6,517,183, issued on Feb. 11, 2003), the disclosure of which is hereby incorporated herein by reference in its entirety.

In order to maintain the quality of the printed output of the printer device, it is important to determine whether each of the nozzles provided on each of the print heads 102–112 is functioning properly. In conventional printers, it is known to attempt to detect an ink droplet as it leaves the nozzle between certain print operations. In this respect, a drop detector module 130 is typically used to determine the health (i.e., the proper functioning) of the printer nozzles 200–200*n*. As seen in FIG. 1, a drop detector module 130 is typically provided outside the region used for printing on to the print medium and generally adjacent to a service station 140 in a conventional printer device.

The service station 140 is generally provided to maintain the health of the print heads 102–112 by providing a means for both cleaning and capping the nozzles 200–200*n* when the printer device is idle. The service station 140 typically includes a plurality of service station units 142–152 for performing servicing operations on the each of the print heads 102–112. Generally, one service station unit 142–152 is provided for each of the print heads 102–112. The service station units 142–152 are typically housed within a service station frame 154. In use, the service station units 142–152 typically function as reservoirs to collect ink fired or "spitted" from a respective one of the print heads 102–112 to thus maintain each of the nozzles 200–200*n* in a functional state. In addition, each of the service station units 142–152 includes a device for capping the print heads 102–112 when the printer device is idle, The drop detection module 130 generally operates to detect whether ink is properly fired from each of the nozzles 200–200*n* of each of the print heads 102–112 by detecting whether a beam of light is broken by an ink droplet. In FIG. 3, there is illustrated schematically a conventional drop detection module 130 used in a printer device. As seen in FIG. 3, the conventional drop detection module 130 generally includes a light emitting diode (LED) 302, a lens 304, a light receiving diode 306, a drop detection unit 308, and an amplifier 312. To detect whether a nozzle is operating properly, a signal is sequentially sent to each nozzle to fire at least one ink droplet. If, in response to the signal, an ink droplet 300 is fired from one of the nozzles (e.g., 202), the ink droplet travels along a path 310. The path 310 traced by the ink droplet 300 is configured to pass between the LED 302 and the light receiving photo diode 306. The light emitted by the LED 302 is collimated by the lens 304 to produce a narrow light beam through which the ink droplet 300 may pass. The lens 304 may be integrally attached to the LED 302 or may constitute a separate element. The photo diode 306 detects the ink droplet 300 by detecting the disturbance in the light beam. In response to the light disruption in the light beam, the photo diode 306 produces a current which is amplified by an amplifier 312 and sent to the drop detection unit 308, The drop detection unit 308 then determines whether the nozzle is operating properly.

The above-described process for determining whether a nozzle is functioning properly is repeated for each of the nozzles 200–200*n* on each of the print heads 102–112. In order to test each of the nozzles 200–200*n*, the set of print heads 100 must be accurately positioned over the drop detection module 130. Accordingly, each of the print heads 102–112 must be moved in the direction 170 sequentially over the drop detection module 130. More particularly, each row of nozzles on each of the print heads 102–112 must moved to a position directly over the light beam for an accurate measurement to be obtained. By virtue of the numerous movements required to position each of the nozzles, the potential for misalignment between the nozzle to be tested and the light beam emitted from the LED 302 is relatively large. Additionally, the amount of time required to maneuver each of the rows of nozzles over the light beam for accurate testing thereof is also relatively large. This may be problematic because the time required to test each of the nozzles may sometimes exceed the amount of time allowed for each of the nozzles to be uncapped (e.g., on the order of about one second). Because of this possibility, in certain instances, it may be necessary to maneuver the set of print heads 100 over the service station 140 to thus perform servicing operations on the print heads 102–112 (e.g., "spit" ink out of some of the nozzles into respective service station units 142–152) while testing the nozzles, thus further increasing the amount of time required to test each of the nozzles 200–200*n*. As can be appreciated from the description above, as the number of print heads and hence the number of nozzles increases, the amount time required to test all of the nozzles also increases, thus substantially increasing the time required to print files onto a print medium.

SUMMARY OF THE INVENTION

According to specific embodiments and methods, the present invention aims to decrease the amount of time required to test the nozzles of a plurality of print heads in a printer device, to thereby improve the throughput of the printer device as well as to decrease the amount of wasted ink.

According to a preferred embodiment, the present invention pertains to a printer device having a plurality of print heads for printing onto a print medium. Each of the print heads has a plurality of nozzles formed into at least one row. The printer device also includes a service station which has a plurality of service station units for performing servicing operations on the print heads. Additionally, a plurality of modules for detecting malfunctioning nozzles is integrated into respective ones of the service station units or, as a multichannel drop detector, into a service station frame.

According to another aspect, the present invention relates to a print head service station for use in a printer device possessing a plurality of service station units. In addition, the service station includes at least one drop detector module for each row of nozzles of each of the print heads. The drop detector module detects ink droplets fired from a nozzle of a plurality of nozzles in a print head to detect malfunctioning nozzles.

According to yet another aspect, the present invention pertains to a method for testing whether a plurality of nozzles of a plurality of print heads are operating properly. In the method, a plurality of print heads are maneuvered to a position substantially above a service station possessing a plurality of service station units, such that each of the print heads is substantially in a position to have ink droplets fired from each of the nozzles tested by a drop detector module. A signal is sent to each of the print heads to fire an ink droplet from each of the nozzles and a drop detector modules whether an ink droplet was fired by the signaled nozzle.

BRIEF DESCRIPTION OF THE DRAWINGS

Features and advantages of the present invention will become apparent to those skilled in the art from the following description with reference to the drawings, in which.

DETAILED DESCRIPTION OF THE INVENTION

For simplicity and illustrative purposes, the principles of the present invention are described by referring mainly to an exemplary embodiment thereof, particularly with references to an example of a large format printer device having six print heads and six service station units. However, one of ordinary skill in the art would readily recognize that the same principles are equally applicable to, and can be implemented in, any printer device that utilizes any number of print heads having a plurality of nozzles and any number of service station units, and that any such variation would be within such modifications that do not depart from the true spirit and scope of the present invention.

Specific methods according to the present invention described herein are directed to printer devices having a print head possessing a plurality of nozzles, each nozzle being configured to spray a stream of droplets of ink. Printing to a print medium is performed by moving the print head into mutually orthogonal directions in between print operations as described hereinabove. However, it will be understood by those skilled in the art that general methods disclosed and identified in the claims herein, are not limited to printer devices having a plurality of nozzles or printer devices with moving print heads.

In the following descriptions of preferred embodiments of the invention, although particular reference is made to print heads 110 and 112 and service station units 150 and 152, it is to be understood that a drop detector module 400 (FIG. 4) is provided for each of the other print heads 102–108 and service station units 142–148. That is, each of the service station units 142–148 may also include drop detector modules positioned in a similar fashion to those illustrated in FIGS. 5A and 5B. Accordingly, any discussion herein pertaining to the drop detector modules 502, 508, 514, 518, 522, 526, print heads 110 and 112, and service station units 150 and 152 is equally applicable to the other drop detector modules, print heads 102–108, and service stations units 142–148. Additionally, it is to be understood that the present invention is not limited to a printer device having six print heads and service station units, but rather, the principles of the present invention are applicable to printer devices having any reasonable number of print heads and service station units.

Figure 1:
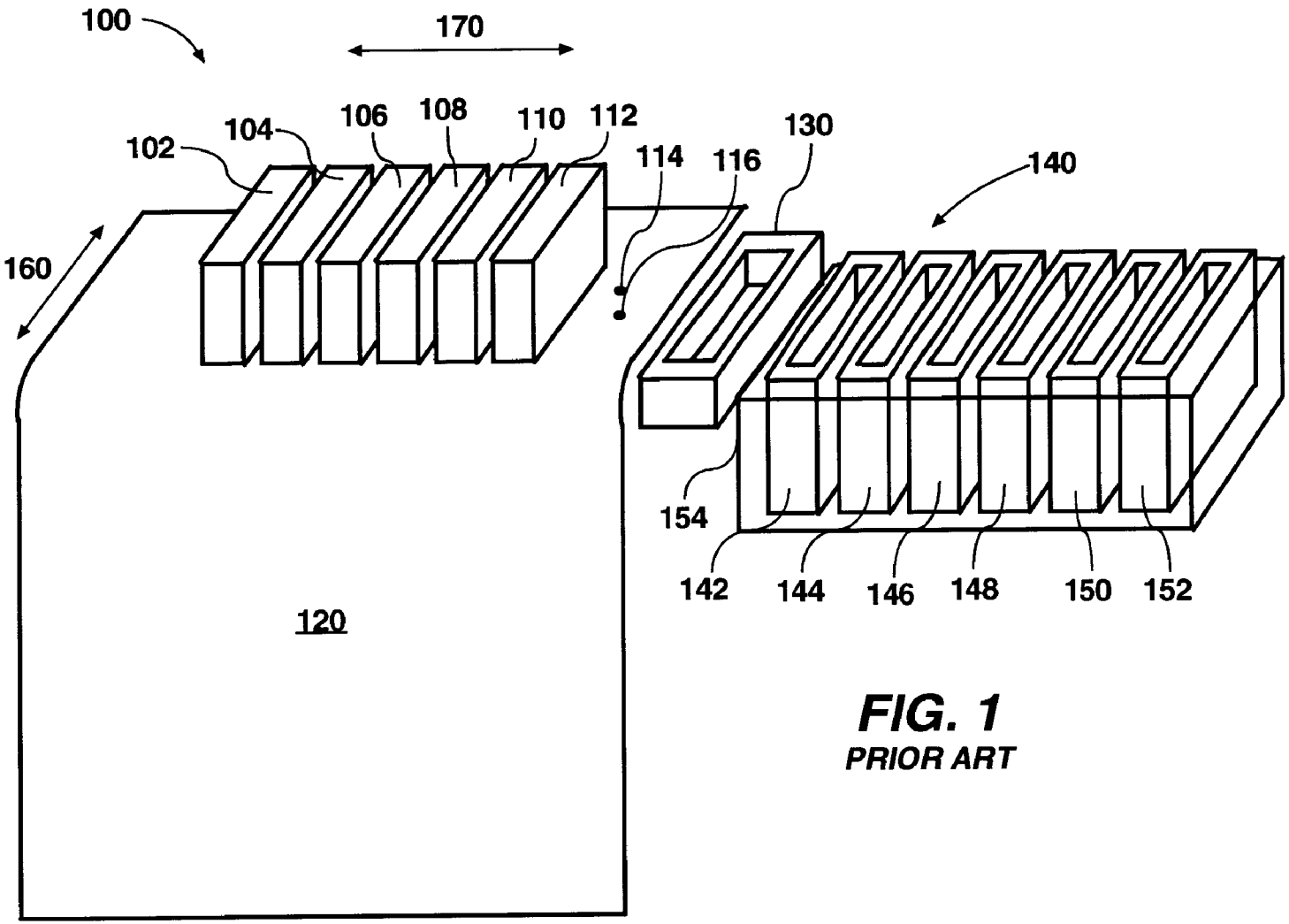
FIG. 1 PRIOR ART
FIG. 1 illustrates a schematic diagram of a conventional printer device showing a manner in which a set of print heads are manipulated with respect to other components of the printer device.
Figure 3:
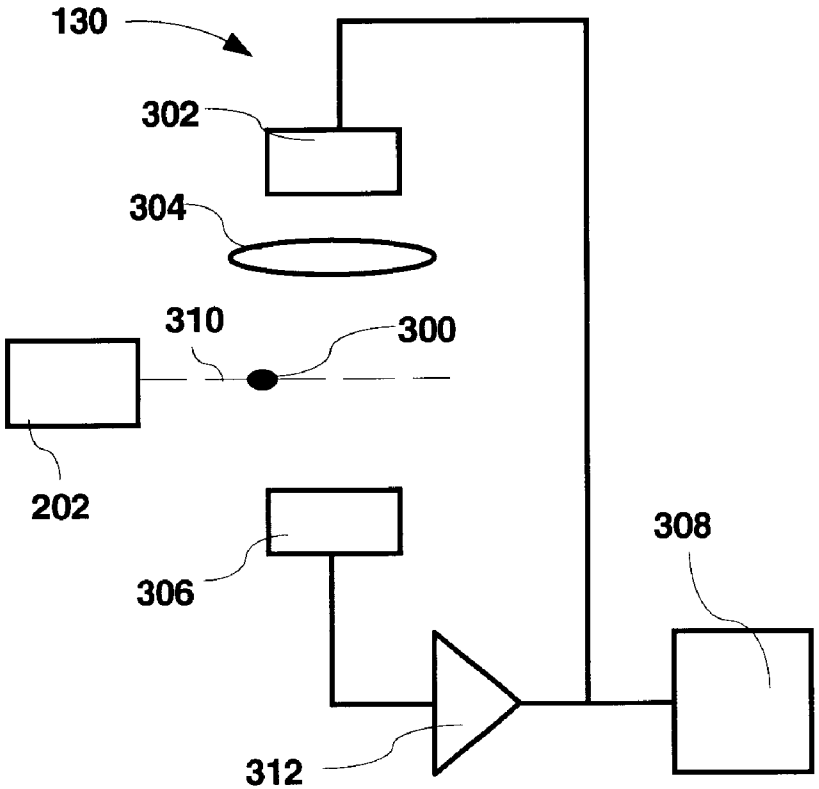
FIG. 3 PRIOR ART
FIG. 3 illustrates a schematic diagram of a conventional drop detector module and shows a manner in which a nozzle of a print head is determined to be operating properly.
Figure 2:
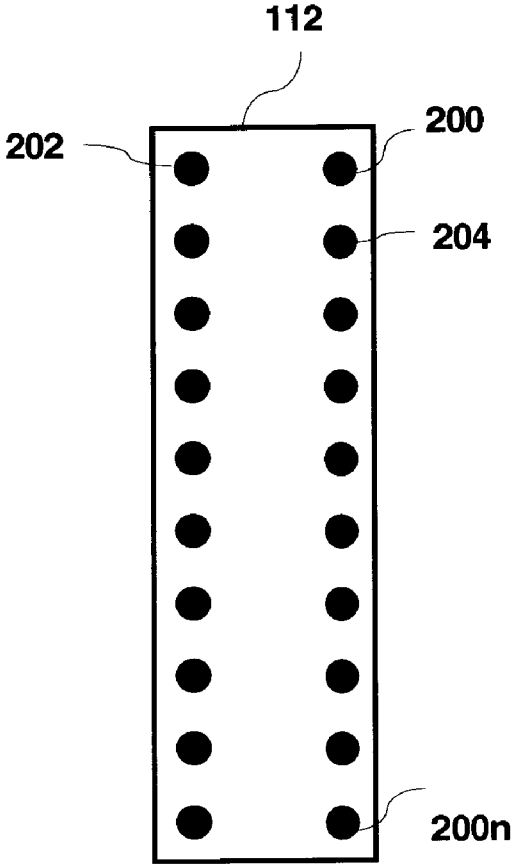
FIG. 2 PRIOR ART
FIG. 2 illustrates a schematic diagram of a conventional print head for use in a conventional printer device showing a manner in which a plurality of nozzles are positioned within the print head.
Figure 4:
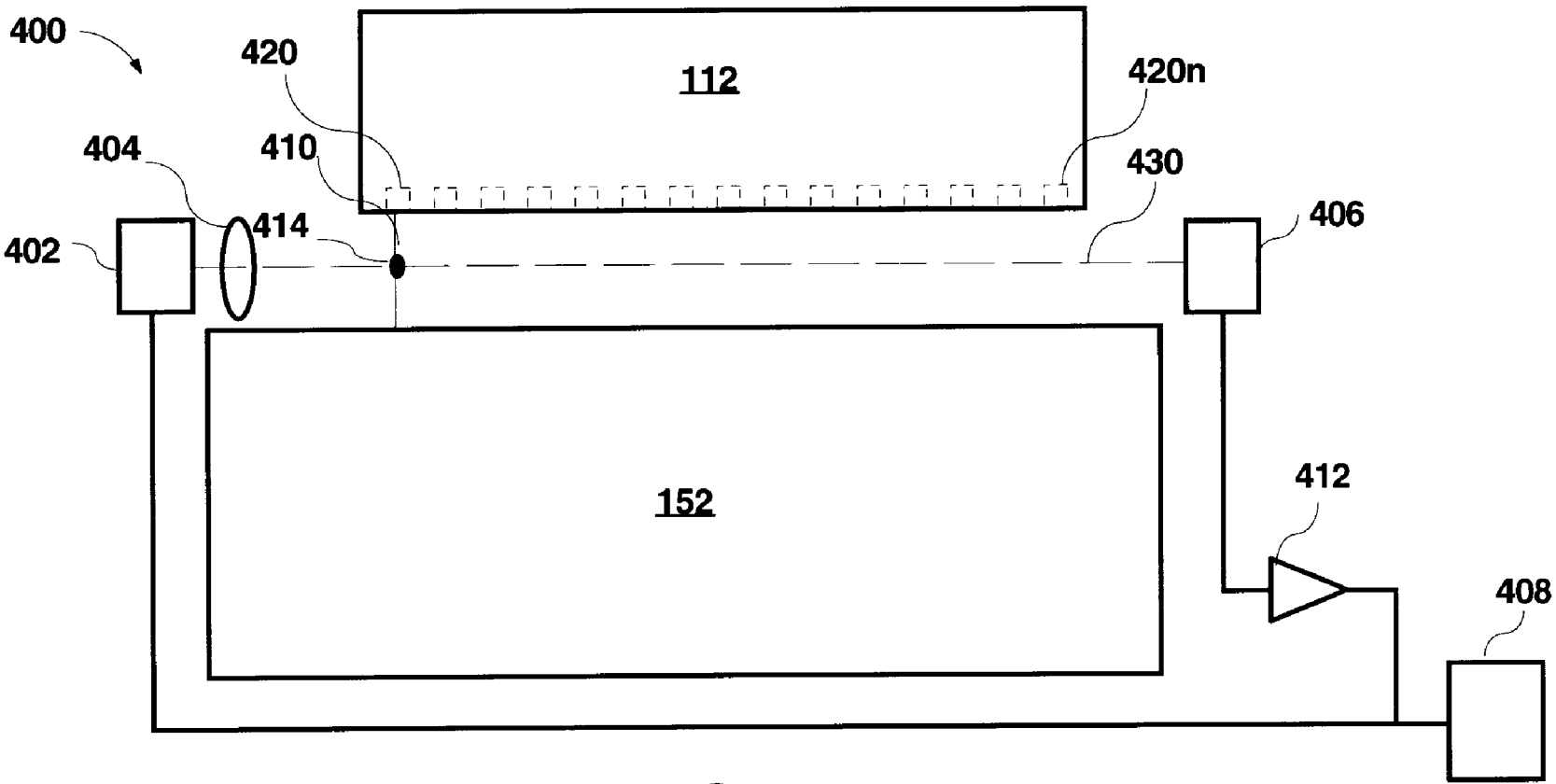
FIG. 4 illustrates a schematic diagram of a drop detector module according to a specific implementation of the present invention shown in relation to one of the print heads and one of the service station units.

Referring to FIG. 4, there is illustrated schematically a drop detector module 400 positioned with respect to a print head 112 and a service station unit 152 in accordance with an embodiment of the present invention. As illustrated in FIG. 4, an ink droplet 414 fired from one of the nozzles 420–420*n* of the print head 112 travels along a path 410. The path 410 intersects a light beam 430 emitted from an optical emitter 402 (e.g., a light emitting diode (LED), filament bulb, and the like). The light beam 430 is thus positioned along a line formed substantially along a hypothetical line formed by joining the centers of all the nozzles in one row of a print head. According to a preferred embodiment, the plane of the light beam 430 is positioned to be substantially parallel to the plane of the nozzles 420–420*n*, such that the light beam is situated substantially the same distance from each of the nozzles in a row of nozzles.

The light emitted from the optical emitter 402 is collimated by a lens 404 into a beam of light, with the beam of light being detected by an optical receiver 406 (e.g., photodiode, phototransistor, and the like). The lens 404 may be integrated with the optical emitter 402 or may constitute a separate element. In either event, in response to the light received, the optical receiver 406 produces a current which is amplified by an amplifier 412 and sent to a drop detection device 408. When an ink droplet 414 passes through the light beam, the ink droplet partially blocks the light input into the photo diode 406 thereby causing the output current of the photo diode to decrease. The drop detection device 408 recognizes the decrease in the output current and determines that that nozzle is operating properly. If an ink droplet is not detected, certain steps may be taken by the printer device to compensate for the malfunctioning nozzle (e.g., print onto the print medium from a different nozzle).

Each nozzle 420–420*n* is configured to release a sequence of ink droplets in response to an instruction from the printer device. By sequentially releasing droplets from each of the nozzles 420–420*n*, each nozzle may be tested to determine whether any of the nozzles are not operating properly.

Figure 5A:
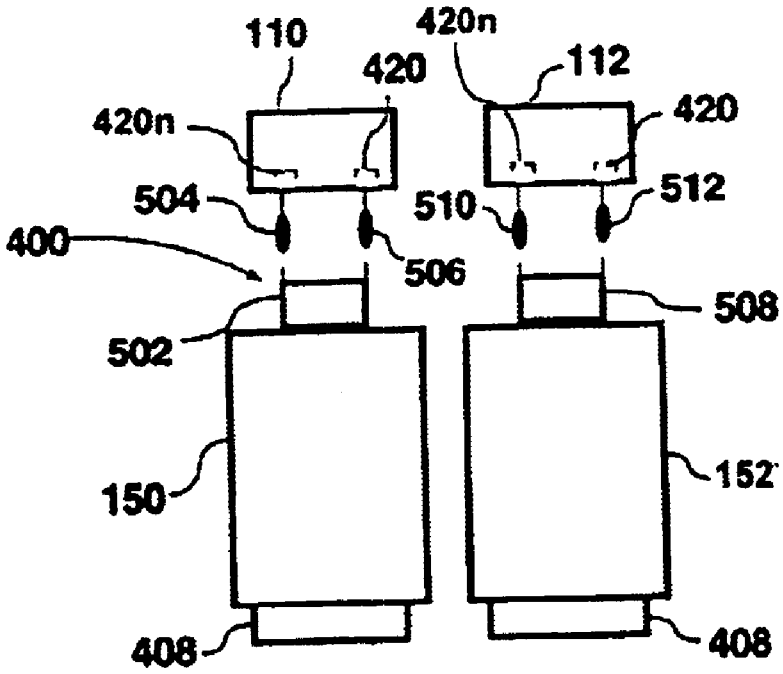
FIGS. 5A and 5B schematically illustrate alternative embodiments of a drop detector module according to specific implementations of the present invention.

In FIG. 5A, there is schematically illustrated a plurality of drop detector modules 502, 508. Drop detector modules 502, 508 are generally positioned to detect droplets of ink 504, 506, 510, 512 fired from each of the nozzles 420–420*n* of print heads 110, 112. The drop detector modules 502, 508 are similar to the drop detector module 400 illustrated in FIG. 4 and each includes all of the components described above with regard to that drop detector module. That is, for example, although hidden from view in FIG. 5A, a pair of optical receivers are respectively positioned on the other side of the service station units 150, 152. Because the print heads 110, 112 are illustrated as possessing two rows of nozzles, the drop detector modules 502, 508 may be configured in a variety of respects to detect ink droplets fired from both rows of nozzles. In this respect, the detector modules 502, 508 each possess a pair of optical emitters to emit light along a pair of light paths (not shown). Alternatively, the detector modules 502, 508 may each possess one optical emitter and at least one mechanism for separating the emitted light into a plurality of beams (e.g., light pipes, lenses, optical fibers, and the like). According to the principles of the present invention, each row of nozzles for each of the print heads 110, 112 may be tested simultaneously to thereby decrease the amount of time required to test whether of each of the print heads is operating properly.

Figure 5B:
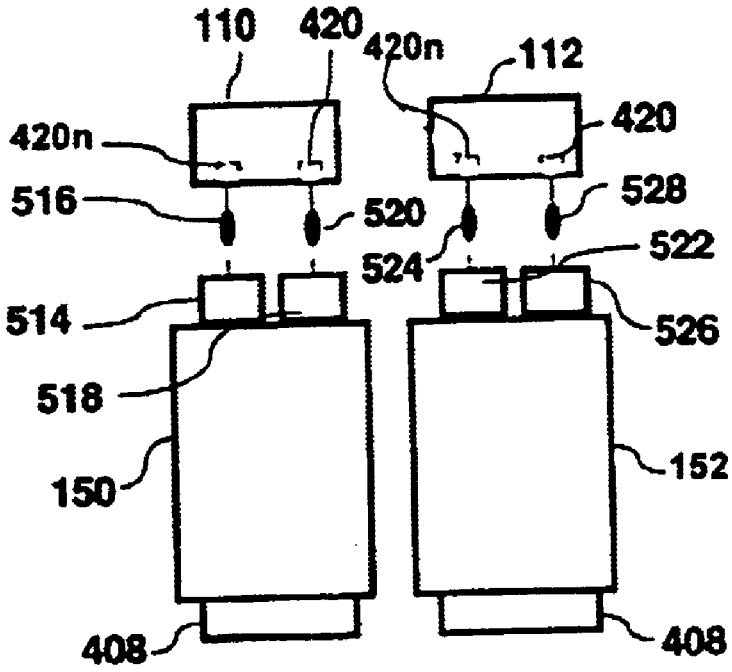

According to another preferred embodiment of the present invention, two sets of drop detector modules 514, 518, 522, 526 are positioned to detect ink droplets 516,520,524,528 fired from each of the rows of nozzles provided on the print heads 110, 112 as illustrated in FIG. 5B. The drop detector modules 514, 518, 522, 526 are similar to the drop detector module 400 illustrated in FIG. 4 and include all of the components described above with regard to the drop detector module 400. That is, for example, although hidden from view in FIG. 5B, a pair of optical receivers are positioned on the other side of each of the service station units 150, 152. Because the print heads 110, 112 are illustrated as possessing two rows of nozzles, the drop detector modules 514,518, 522,526 are configured to detect ink droplets fired from a respective row of nozzles on a respective print head. In this respect, the print heads 110, 112 may be configured to simultaneously fire from a nozzle of both rows of nozzles to thereby decrease the amount of time required to test whether each of the nozzles is operating properly.

Figure 6:
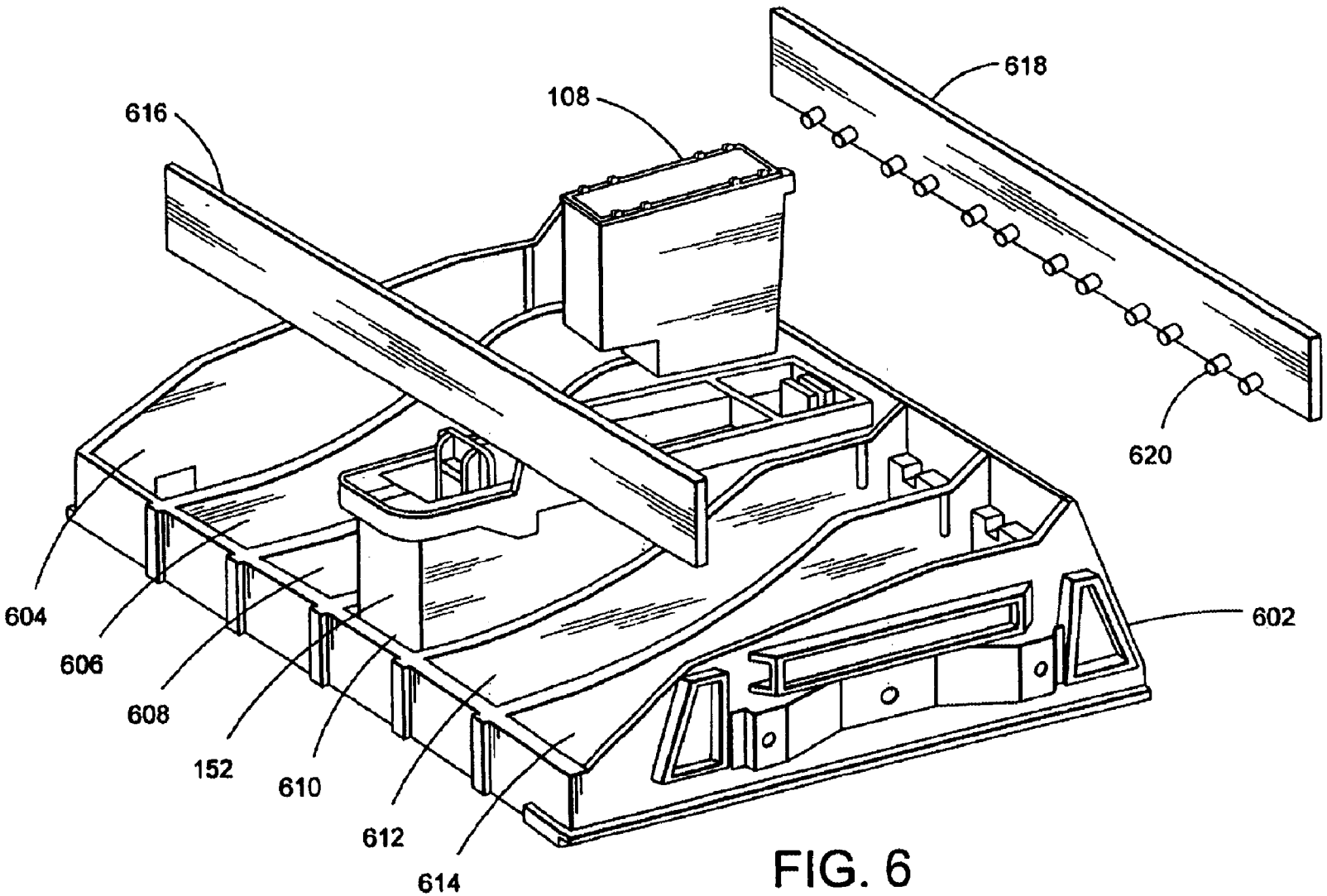
FIG. 6 is a perspective view of a service station carriage illustrating a manner in which a plurality of optical emitters and optical receivers may be positioned with respect to a print head in accordance with the principles of the present invention.

FIG. 6 illustrates a perspective view of a printer service station carriage 602 having a plurality of compartments 604–614 for housing individual service station units 142–152. Illustrated in FIG. 6 is a printer service station unit 152 housed within compartment 610 and a print head 108 in position over the printer service station unit to have servicing operations performed on the nozzles (not shown) of the print head. Although only one service station unit 152 and one print head 108 are illustrated in FIG. 6, the service station carriage 602 is configured to house individual service station units within each of the compartments 604–614 to thus provide service station units for each of the print heads 102–112.

Also illustrated in FIG. 6 is a multichannel drop detector possessing a pair of substrates 616, 618, each of which possesses a plurality of optical emitters 622 (FIG. 7) and/or optical receivers 620 which operate in a manner similar to that described hereinabove with respect to FIGS. 4, 5A, and 5B. That is, one of the substrates 616, 618 may possess a plurality of optical emitters 622 (FIG. 7) whereas the other of the substrates may possess a plurality of optical receivers 620. In addition, one or both of the substrates 616, 618 may be composed of printed circuit boards housing the optical emitters and/or optical receivers 620. In accordance with a preferred embodiment of the present invention, the electronics (e.g., amplifier, detector, etc.) are positioned on the substrate 616, 618 housing the optical receivers 620. However, the electronics may be positioned on the substrate 616, 618 housing the optical emitters 622 or on a separate substrate (not shown). Additionally, as illustrated in FIG. 8, the electronics may be positioned within a printer electronics box 802 which includes the electronics for controlling operations of the printer.

Although not specifically illustrated in FIG. 6, the print head 108 possesses two rows of nozzles. Thus, the substrates 616,618 possess pairs of optical emitters 622 and optical receivers 620 to create a plurality of light beams which intersect the flight paths of ink droplets fired from each row of nozzles. Thus, it is readily apparent that the optical emitters 622 and the optical receivers 620 may be positioned on either side of the print head 108, such that an optical receiver is positioned opposite an optical emitter.

Figure 7:
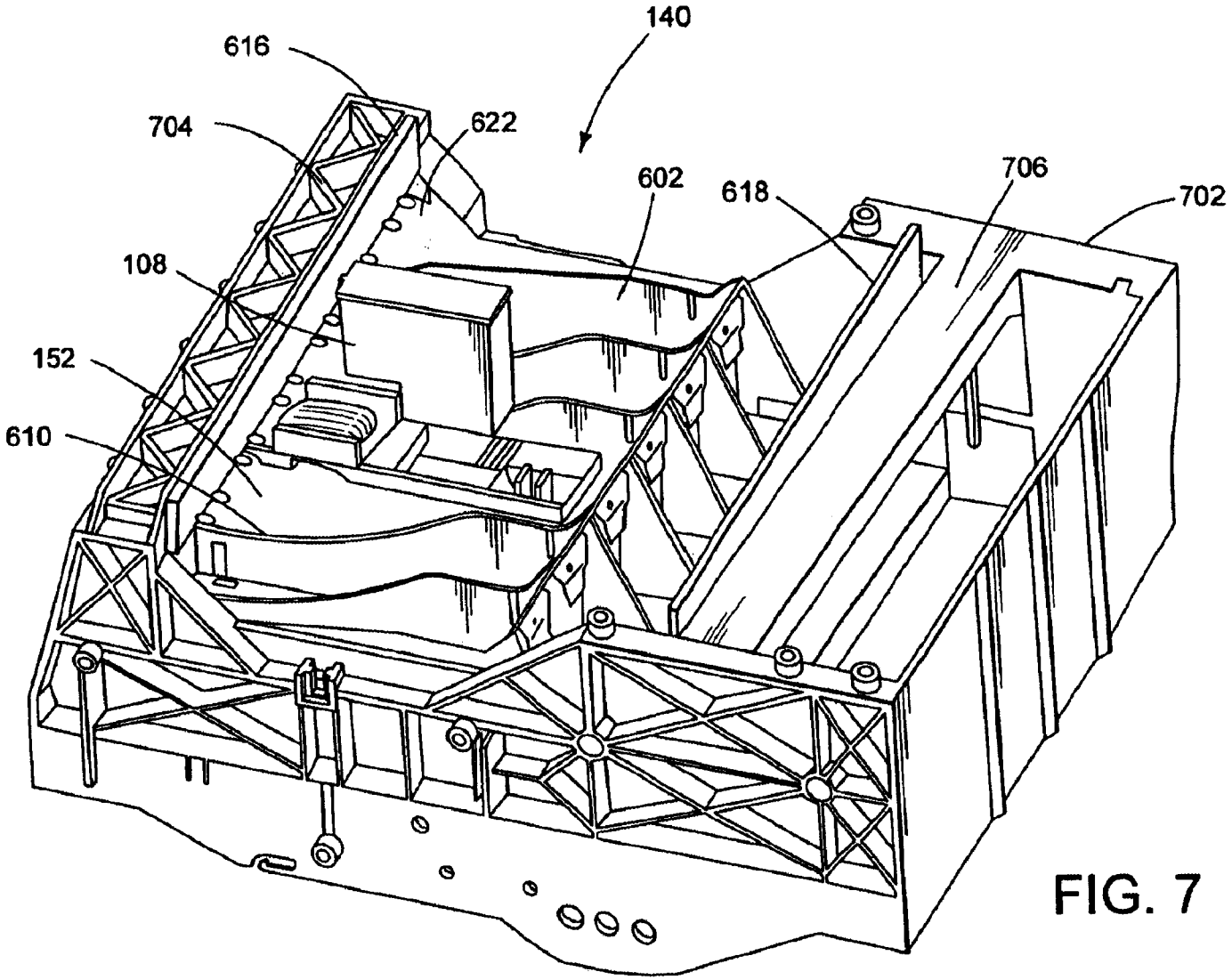
FIG. 7 is a perspective view of a service station illustrating a manner in which a printer service station carriage may be housed within a printer service station casing, such that the casing supports a plurality of optical emitters and optical receivers in accordance with the principles of the present invention.
Figure 8:
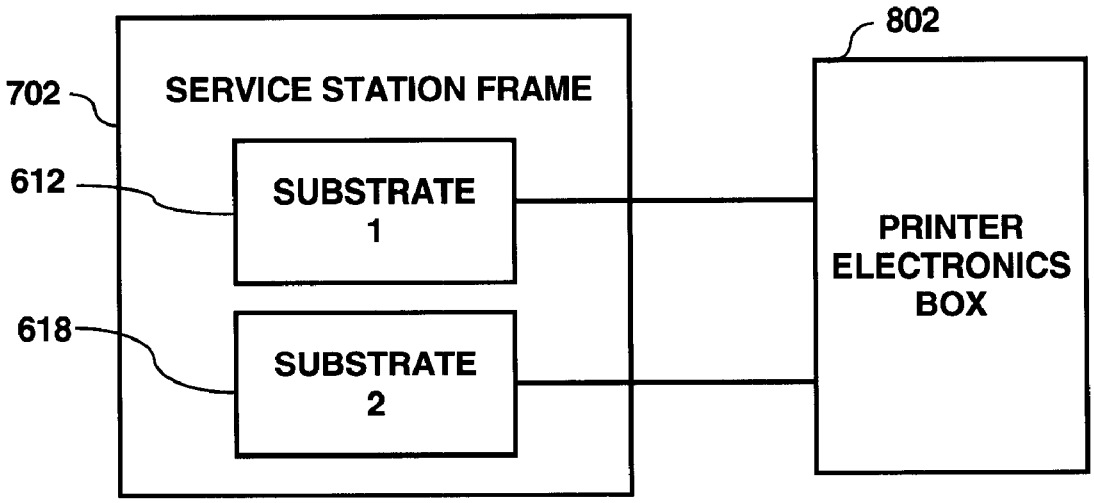
FIG. 8 is a schematic block diagram of a portion of a printer in accordance with an embodiment of the present invention.

In FIG. 7, there is illustrated a perspective view of a printer service station 140 having a service station frame

702. The service station frame 702 is configured to house the service station carriage 602 illustrated in FIG. 6. As illustrated in FIG. 7, a service station unit 152 is housed within a compartment 610 of the service station carriage 602. Additionally, a print head 108 is positioned over the service station unit 152 to have servicing operations performed on the nozzles (not shown) of the print head. In a similar fashion to that illustrated in FIG. 6, a multichannel drop detector having a pair of substrates 616, 618, each possessing a plurality of optical emitters 622 and/or optical receivers 620 are illustrated as being in position to detect fired ink droplets from the print head 108. Thus, the multichannel drop detector depicted in FIG. 7 is identical to the drop detector depicted in FIG. 6. FIG. 7 illustrates that the substrates 616,618 are attached to respective railings 704, 706 of the service station frame 702. In this respect, the substrates 616,618 may be attached to the respective railings 704,706 by any known reasonably suitable means, e.g., adhesive, mechanical fasteners, welding, etc. By virtue of the configuration depicted in FIG. 7, the substrates 616, 618 may be placed in operable position to detect malfunctioning nozzles without substantially interfering with the printer service station 140 operations (e.g., as a receptacle for spitted ink, capping of the print heads, etc.).

Although specific reference has been made hereinabove to print heads 110, 112 possessing one or two rows of nozzles, it is to be understood that the present invention is not limited to the testing of print heads having only one or two rows of nozzles. Instead, the present invention is operable with print heads having any number of nozzle rows.

Figure 9:
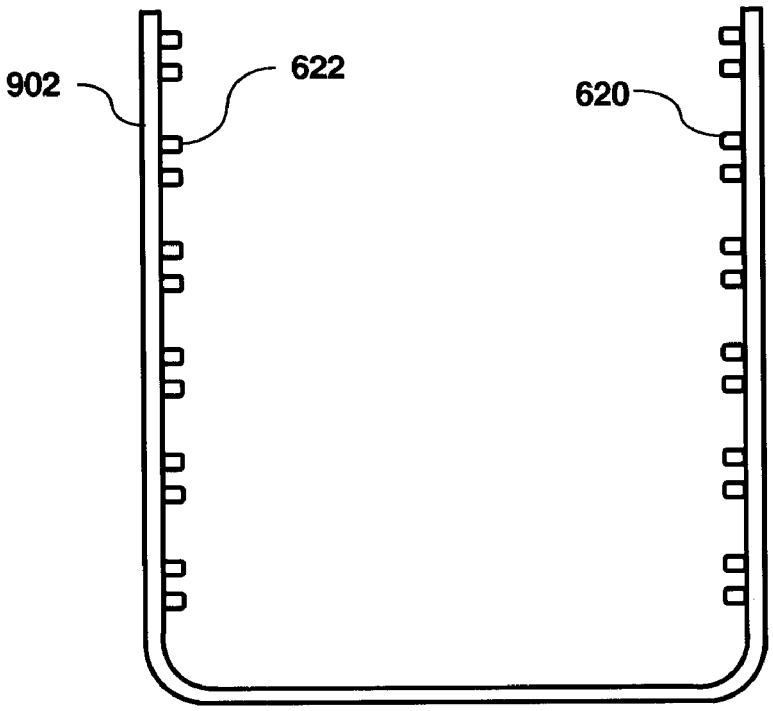
FIG. 9 is a front view of a flexible substrate of a multichannel drop detector in accordance with another embodiment of the present invention.

Additionally, although the multichannel drop detector was described hereinabove and depicted in FIGS. 6 and 7 as being composed of a pair of substrates 616, 618, it is within the purview of the present invention that the multichannel drop detector may be composed of a single flexible substrate 902 as seen in FIG. 9. In this respect, the optical emitters 622 and the optical receivers 620 may be provided along the single flexible substrate 902, such that, once the flexible substrate is mounted on the service station frame 702, the optical emitters and the optical receivers may be substantially aligned with respect to each other. Moreover, the flexible substrate 902 may be attached to the respective railings 704,706 of the service station frame 702 by any known reasonably suitable means, e.g., adhesive, mechanical fasteners, welding, etc. Furthermore, the electronics of the multichannel drop detector may be provided in a similar manner to those positions discussed hereinabove with respect to the substrates 616, 618 illustrated in FIGS. 6 and 7.

In accordance with the principles of the present invention, by providing a drop detector module or a multichannel drop detector on each of the service station units 142–152, each of the print heads 102–112 may be tested substantially simultaneously. More specifically, each row of nozzles of each print head 102–112 may be tested substantially simultaneously. Additionally, each of the print heads 102–112 may be tested at the service station 140 instead of at a separate drop detector module as is practiced in conventional printer systems. In general, nozzle functionality is typically tested before starting a print job or after the print job is finished. In both cases, the print heads 142–152 are typically positioned over the service station 140. Therefore, additional time to maneuver the print heads 142–152 to test the nozzle functionality is not required. By virtue of the substantially simultaneous testing and placement of ink drop detection, the amount of time required to test the nozzles is substantially reduced. Accordingly, the amount of time that the print heads 102–112 are uncapped is correspondingly reduced, thereby increasing the life span of the print heads.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims—and their equivalents—in which all terms are meant in their broadest reasonable sense unless otherwise indicated.

What is claimed is:

1. A printer device for printing onto a print medium, said printer device comprising: a plurality of print heads, each of said print heads having a plurality of nozzles formed into at least one row; a service station having a plurality of service station units housed within a service station frame for performing servicing operations on said print heads; and a plurality of drop detector modules for detecting malfunctioning nozzles in said plurality of print heads, each of said drop detector modules being integrated into said service station.

2. The printer device according to claim 1, wherein said printer device comprises at least two print heads and at least two service station units.

3. The printer device according to claim 1, wherein said service station units are configured to cap said print heads and for providing receptacles for each of said nozzles to spit ink.

4. The printer device according to claim 1, wherein each of said drop detector modules possesses at least one optical emitter and at least one optical receiver.

5. The printer device according to claim 4, wherein each of said drop detector modules includes at least one lens configured to focus a light signal from said optical emitter into a light beam and wherein said drop detector module is positioned with respect to each of the service station units such that said light beam may be located in a path of an ink droplet fired from one of said nozzles and into a respective service station unit.

6. The printer device according to claim 5, wherein each said at least one light focusing mechanism is operable to focus or split said light signal into at least two light beams, and at least two mechanisms for receiving said at least two light beams, wherein each of said light beams is configured to cross a path of an ink droplet fired from a row of nozzles into a respective service station unit.

7. The printer device according to claim 6, wherein said light beams and said light receiving mechanisms are configured to detect ink droplets fired from a respective nozzle of each row of nozzles simultaneously.

8. The printer device according to claim 5, wherein each of said service stations includes at least two drop detector modules, each of said drop detector modules having an optical emitter, a mechanism for focusing a light signal emitted from said optical emitter into a light beam, and an optical receiver, wherein a respective drop detector module is positioned to simultaneously detect droplets of ink ejected from each row of nozzles.

9. The printer device according to claim 4, wherein each of said optical emitters is provided on a first substrate and each of said optical receivers are provided on a second substrate, and wherein said first substrate is attached on a first side of said service station frame and said second substrate is attached on a second side of said service station frame opposite said first side.

10. A print head service station for use in a printer device, said print head service station comprising: a plurality of service station units housed within a service station frame; and at least one drop detector module provided in said service station for detecting ink droplets fired from a nozzle of a plurality of nozzles in a print head to detect malfunctioning nozzles.

11. The print head service station according to claim 10, wherein each said at least one drop detector module includes an optical emitter for emitting a light signal, a mechanism configured to focus said light signal into a light beam, and an optical receiver for receiving said light beam.

12. The print head service station according to claim 11, wherein each said optical emitter, optical receiver, and light focusing mechanism are configured to test each row of nozzles for each print head tested.

13. The print head service station according to claim 11, wherein each said optical emitter is provided on a first substrate and each said optical receiver is provided on a second substrate, and wherein said first substrate is attached on a first side of said service station frame and said second substrate is attached on a second side of said service station frame opposite said first side

14. The print head service station according to claim 13, further comprising an amplifier and a detection device.

15. The print head service station according to claim 14, wherein said amplifier and said detection device are provided on said first substrate.

16. The print service station according to claim 14, wherein said amplifier and said detection device are provided on said second substrate.

17. The print head service station according to claim 14, wherein said amplifier and said detection device are provided on a third substrate.

18. The print head service station according to claim 11, wherein each said optical emitter and each said optical receiver is provided on a flexible substrate.

19. The print head service station according to claim 18, wherein said flexible substrate is attached on both a first side and a second side of service station frame.

20. The print head service station according to claim 18, wherein an amplifier and a detection device are provided on said flexible substrate.

21. The print head service station according to claim 20, wherein said amplifier and said detection device are provided in a printer electronics box.

22. The print head service station according to claim 10, wherein said nozzles of said print heads are provided in at least one row and said drop detector module includes at least one light emitting element, at least one light receiving element, and at least one mechanism for focusing or splitting said light signal into at least one light beam, such that, each said light beam is configured to cross a path of an ink droplet fired from a nozzle located in each said row of nozzles.

23. A method for testing the functionality of a plurality of nozzles of a plurality of print heads, said method comprising the steps of: maneuvering a plurality of print heads to a position substantially above a service station possessing a plurality of service station units to place each of said print heads substantially in a position to have ink droplets fired from each of the nozzles tested by at least one drop detector module; sending a signal to at least one of the print heads to fire an ink droplet from at least one of the nozzles; and detecting whether an ink droplet was fired by said at least one nozzle with each said drop detector module.

24. The method for testing according to claim 23, wherein said signal sending step includes the further step of simultaneously sending a firing signal to each of said print heads to fire an ink droplet from said at least one nozzle.

25. The method for testing according to claim 24, wherein said nozzles of each of said print heads are provided in at least one row and said signal sending step includes the further step of simultaneously sending a firing signal to at least one of the print heads to fire an ink droplet from a nozzle located in each said row and wherein said detecting step includes the step of detecting whether an ink droplet was fired from said nozzles located in each said row.

26. The method for testing according to claim 24, wherein said signal sending step comprises the further step of simultaneously sending a firing signal to each of said print heads to fire an ink droplet from a nozzle located in each said row and wherein said detecting step includes the step of detecting whether an ink droplet was fired from nozzles located in each said row of each said print head.

* * * * *